US005356049A

United States Patent [19]

Harris et al.

[11] Patent Number: 5,356,049

[45] Date of Patent: Oct. 18, 1994

[54] HAND PUMP ASSEMBLY WITH A PUMP MECHANISM WHICH IS INDEPENDENT OF THE PUMP HOUSING

[75] Inventors: Clark E. Harris, Fairport; Bradley S. Bush, Hilton; Michael W. Didas, Rochester; Anthony J. Imperato, Purdys, all of N.Y.

[73] Assignee: Eastman Kodak Company, Rochester, N.Y.

[21] Appl. No.: 38,957

[22] Filed: Mar. 29, 1993

[51] Int. Cl.[5] ..... B67D 5/40

[52] U.S. Cl. ..... 222/383; 222/382

[58] Field of Search ..... 222/183, 182, 173, 382, 222/383, 341; 239/333

[56] References Cited

U.S. PATENT DOCUMENTS

| | | | |
|---|---|---|---|
| 3,701,478 | 10/1972 | Tada . | |
| 3,840,157 | 10/1974 | Hellenkamp . | |
| 4,155,487 | 5/1979 | Blake | 222/383 X |
| 4,161,288 | 7/1979 | McKinney . | |
| 4,336,895 | 6/1982 | Aleff | 222/383 X |
| 4,352,443 | 10/1982 | Libit | 222/383 |
| 4,480,768 | 11/1984 | Martin . | |
| 4,676,408 | 6/1987 | Speitel | 222/183 |
| 4,691,849 | 9/1987 | Tada | 222/382 |
| 4,944,431 | 7/1990 | Blake . | |
| 4,953,791 | 9/1990 | Tada . | |
| 5,040,701 | 8/1991 | Knickerbocker et al. | 222/182 X |
| 5,152,436 | 10/1992 | Maas et al. | 222/383 |
| 5,156,304 | 10/1992 | Battegazzore | 222/383 X |

*Primary Examiner*—Gregory L. Huson

*Attorney, Agent, or Firm*—John R. Everett

[57] ABSTRACT

A hand-held spray pump includes a pump mechanism which may be pre-assembled and a pump housing which receives and encloses the pump mechanism. The pump mechanism includes a minimal number of inexpensive parts which are slidably assembled and snapped together. The housing includes a body portion and a cover portion with the body portion slidably receiving a trigger for operating the pump mechanism and for slidably receiving the pump mechanism. After the pump mechanism has been inserted into the body portion, the cover is snap-fitted over the pump mechanism. By utilizing the aforedescribed configuration, the pump housing may be readily changed without requiring changes in the configuration of the pump mechanism.

5 Claims, 3 Drawing Sheets

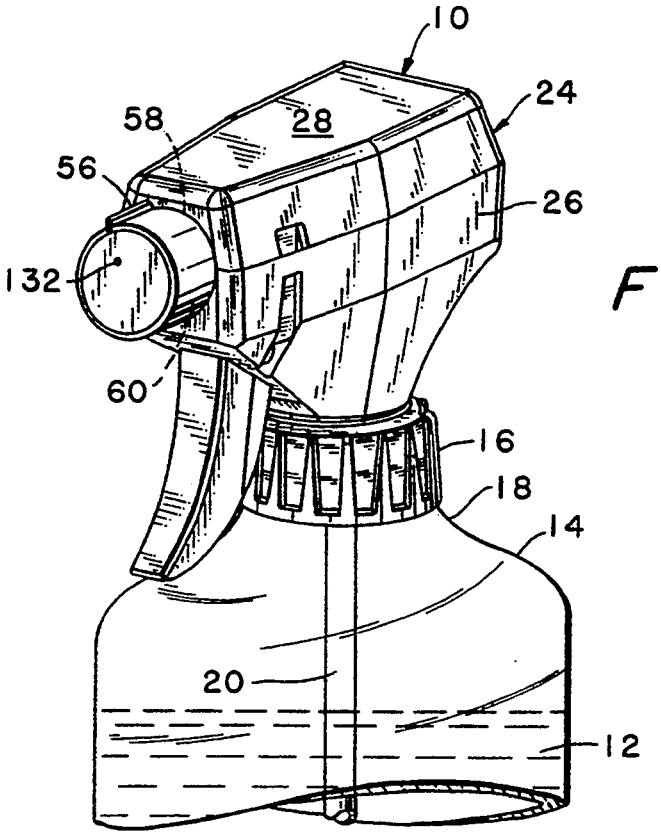
FIG. 1
FIG. 2
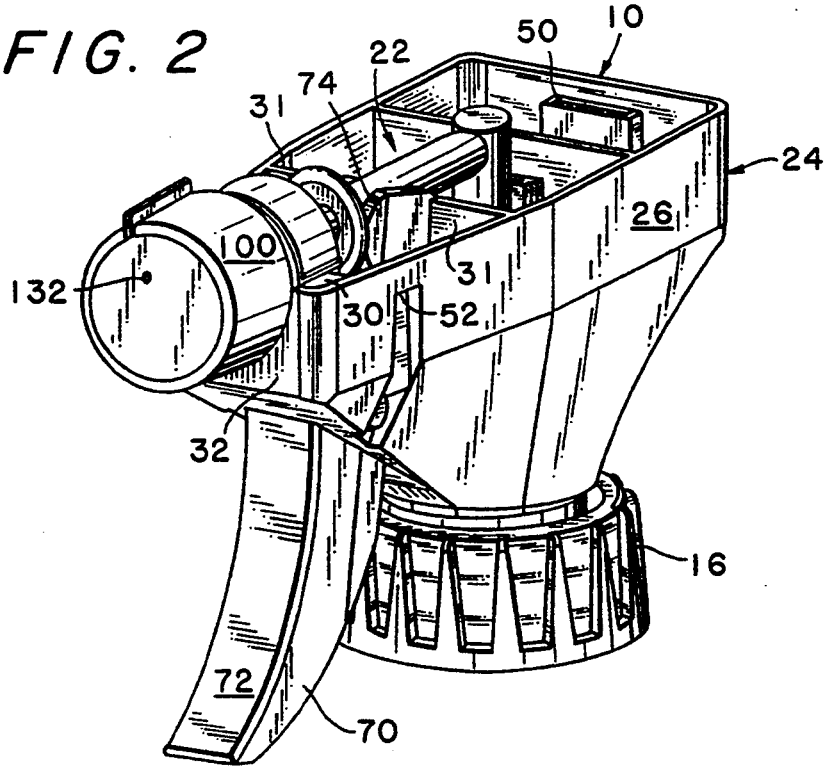

HAND PUMP ASSEMBLY WITH A PUMP MECHANISM WHICH IS INDEPENDENT OF THE PUMP HOUSING

FIELD OF THE INVENTION

The present invention relates to hand-held spray pumps. More particularly, the present invention relates to hand-held spray pumps for dispensing liquids from containers.

BACKGROUND ART

Hand-held spray pumps are manufactured by the millions and are mainly used to dispense products such as household cleaners. These pumps have tended in the past to be rather complex in configuration and having numerous complex parts. In addition, hand-held spray pumps require assembly of these rather complex parts which can be in and of itself complex. Since manufacturing expense is frequently associated with product complexity it is desirable to reduce complexity if possible.

In marketing and utilizing hand pumps, it is from time to time desirable to change various aspects of the pump housing. Since changes in the configuration of the housing may well require chances in the orientation and thus the operation of the pump mechanism, this can be an expensive undertaking if the pump mechanism is integral with the pump housing. Since the configuration of the usual pump mechanism does not necessarily depend on the liquid being pumped or the purpose for which pumped liquid is employed, the same fundamental pump mechanism may be used for many liquids. In order to accommodate the mode in which liquid is dispensed from the pump mechanism, it is necessary to only reconfigure the nozzle through which the liquid is ultimately dispensed and perhaps the design of structure just upstream of the nozzle.

Hand-held spray pumps are now almost universally fabricated from resin materials which are becoming increasingly expensive. Accordingly, it is desirable to configure pump structure with minimal amounts of resinous material.

While the prior art includes a number of approaches for reducing the number of parts in hand-held spray pumps as well as several spray pumps in which an attempt is made to separate the structure of the pump mechanism from that of the housing and even that of the trigger, the prior art does not include hand-held spray pumps to minimize expense while maximizing convenience through addressing each of the above-identified concerns.

SUMMARY OF THE INVENTION

In view of the aforementioned goals, it is a feature of the instant invention to provide a new and improved hand-held spray pump wherein the hand-held spray pump is configured of a minimum number of parts and wherein the pump mechanism is separate from the housing containing the pump mechanism.

In view of the aforementioned features and other features, the instant invention provides a pump for pumping liquid from a container wherein the pump comprises a housing having a body portion and a cover portion with the portions including means for snapping the cover onto the body. A pump mechanism having no components in common with the housing is mounted in the housing so that the configuration of the housing may be changed without necessarily changing the pump mechanism. The pump mechanism comprises a suction tube extending from the pump assembly into the liquid within the container and the chamber for storing and discharging a charge of liquid withdrawn from the container and stored in the pump. A piston is reciprocal in the chamber for charging and discharging the chamber upon reciprocation therein and a nozzle is provided downstream of the chamber for dispensing liquid discharged from the chamber. The body portion of the housing includes support means for slidably receiving the pump assembly as a unit and for aligning the pump assembly with a trigger prior to snap fitting the cover portion of the housing to the body portion.

The instant invention further contemplates a pump mechanism for pumping the liquid from a container wherein the pump mechanism comprises a suction tube for sucking liquid from the container into the pump mechanism, a piston connected to the suction tube and a chamber for slidably receiving the piston. During operation of the mechanism, liquid was passed from the suction tube through the piston and into the chamber. A suction valve associated with the piston opens to allow passage of liquid through the piston and closes for blocking passage of liquid through the piston in order to charge the chamber with liquid. A pressure valve is connected to the chamber and disposed downstream of the suction valve to close while the suction valve is open and to open while the suction valve is closed thereby sucking the liquid into the chamber and permitting passage of the liquid out of the chamber as the piston moves in the chamber.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein:

FIG. 1 is a perspective view showing a pump in accordance with the instant invention mounted on a container for dispensing liquid from the container;

FIG. 2 is an enlarged perspective view of the pump of FIG. 1 showing a cover portion removed;

DETAILED DESCRIPTION

Figure 3:
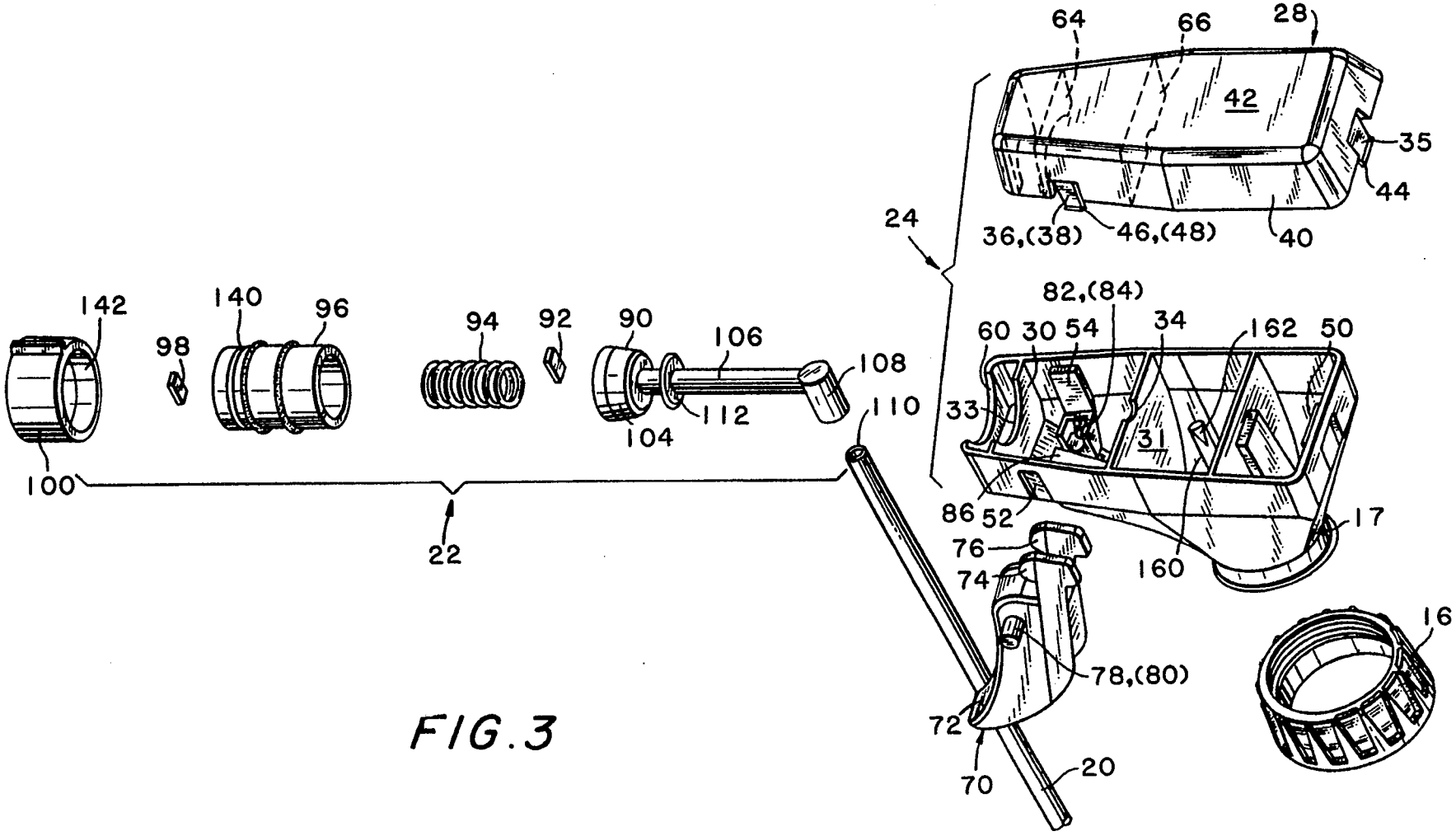
FIG. 3 is an exploded view, in perspective, of the pump and its components with some cover portion parts shown in phantom.

Referring now to FIG. 1, there is shown a hand-held spray pump designated generally by the numeral 10 and configured in accordance with the principles of the instant invention, for dispensing liquid 12 from a container 14. Spray pump 10 is retained on the container 14 by a collar 16 which may, for example, be threaded onto the neck 18 of the container. While threading the collar 16 onto the neck of the container 18 is one way of securing the pump 10 to the container, any other coupling arrangement for coupling the spray pump on the container may be used. The liquid 12 is drawn to the spray pump 10 by a suction tube 20 which is connected to a pump mechanism, such as the pump mechanism generally designated by the numeral 22, shown in FIGS. 2–5. Pump mechanism 22 is mounted in a housing, designated generally by the numeral 24, which has a body portion 26 and a cover portion 28.

Referring now to FIG. 2, which shows the spray pump 10 with the pump mechanism 22 within the body portion 26 housing 24, but with the cover portion 28 not yet in place, it is seen that the pump mechanism is supported by bulk heads 30 and 31 as well as end wall 32 of the body portion of the housing. No structure within the body portion 26 of the housing 24 overlies the pump mechanism 22 so that the pump mechanism may be lowered into the body portion 24 prior to snap engaging the cover 28 (FIG. 1) on the body portion 26. Preferably the pump mechanism 22 is snap fitted into grooves 33 and 34 in bulkheads 30 and 31, respectively.

Referring now to FIG. 3, it is seen that the cover 28 has a rear detent 35 and side detents 36 and 38 which are integral with a side skirt 40 depending from a top wall 42 of the housing cover 28. The detents 35, 36 and 38 have lips 44, 46 and 48, which are received under shelves provided in locking slots 50, 52 and 54, respectively. The detent locking arrangements are of a conventional nature and serve the purpose of providing a permanent mechanical connection between the cover portion 28 and the body portion 26 so that the cover portion 28 is not readily removable from the body portion.

The cover portion 28 preferably has a front wall 56 (see FIG. 1 and dotted lines FIG. 3) which has a semicircular opening 58 which cooperates with a semicircular opening 60 in the front wall 32 of the body portion to retain a portion of the pump mechanism 22. The cover 34 also includes bulk heads 64 and 66 (dotted lines FIG. 3) therewithin which cooperate with bulkheads 30 and 31 of the body portion 26 to secure the pump mechanism 22 in place within the housing 24 when the cover portion 28 is snap-fitted on the body portion 26.

The pump mechanism 22 is operated by a trigger 70. The trigger 70 is a unitary piece comprised of a finger piece 72, a pair of spaced cams 74 and 76 and a pair of pivot pins 78 and 80. During assembly of the pump, the trigger 70 is dropped into the body portion so that the pivot pins 78 and 80 are received in trunions 82 and 84 with the finger piece 72 passing through an opening 86 in the bottom of the body portion 26 of the housing 24. When the trigger 72 is operated by pressing on the finger pole 72, the cam surfaces 76 and 74 rotate so as to operate the pump mechanism 22.

The pump assembly 22 which is connected to the suction pipe 20 is comprised of a piston 90, a suction valve 92 which is mounted on the piston, a coil spring 94 which the piston abuts, a chamber in the form of a barrel 96, a pressure valve 98 and a dispensing cap 100. The piston 90 includes piston head 104 which is connected to a piston tube 106, the piston tube having a radially extended coupling section 108 which slidably receives the top 110 of suction tube 20. Disposed around the piston tube 106 is a radial flange 112 which is engaged by the cams 74 and 76 on the trigger 70 to project the piston head.

Figure 4:
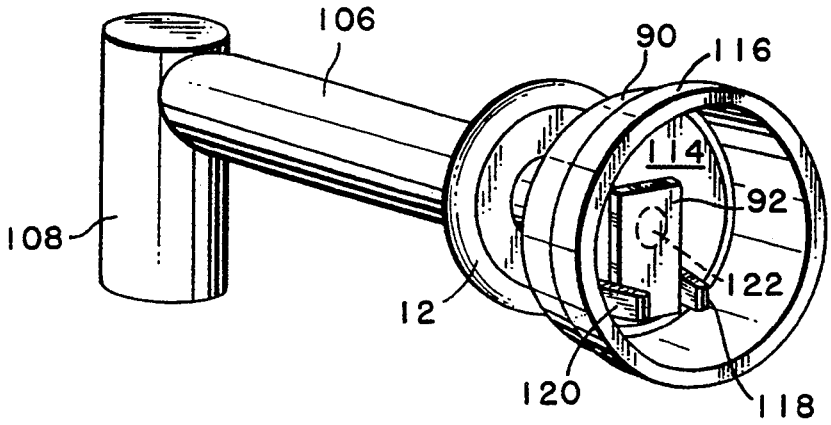
FIG. 4 is a perspective view of a pump piston comprising a component of a pump mechanism shown in FIG. 3.
Figure 5:
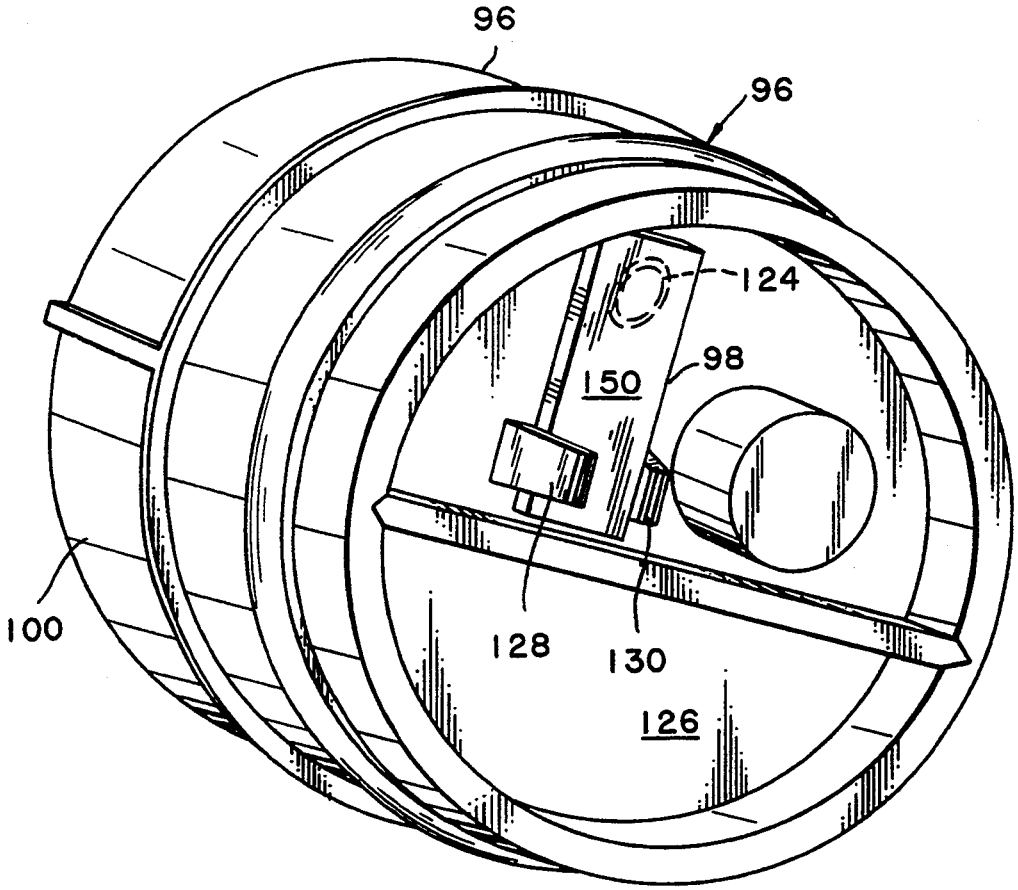
FIG. 5 is a perspective view of a barrel-type chamber which receives the piston of FIG. 4 when configuring the pump mechanism of FIG. 3.

Referring now to FIG. 4, it is seen that the piston head 90 is hollow and has an interior piston face 114 surrounded by skirt 116. Depending from the piston face 114 are a pair of standing ribs 118 and 120 which receive therebetween the suction valve 92. When the suction valve 92 is open, the suction valve 92 covers a port 122 through the piston face 114 which is aligned with the piston tube 106. The suction valve 92 allows liquid 12 in the container 14 to be sucked up through the suction tube 20, through the coupling 108, into the piston tube 106 and out of the port 122. When the suction valve 92 is closed, liquid 12 cannot flow past the piston face 114, back down through the suction tube 20 and into the container 14.

Referring again mainly to FIG. 3, the piston head 90 is received with a sliding fit within the chamber or barrel 96 and is biased by the spring 94 to a first position. Upon squeezing the trigger 70, the cams 74 and 76 engage the flange 112 and move the piston 90 from the first position toward a second position against the bias of the spring. Fluid within the chamber or barrel 96 then keeps the valve 92 pressed against the bore 122, keeping the valve closed so that as the piston 90 moves into the barrel 96, fluid (including liquid and maybe air) in the chamber 96 has nowhere to go but out of a bore 124 in an end wall 126 of the cylinder 96 (FIG. 4). The pressure valve 98 is positioned over the bore 124 and held in place by standing ribs 128 and 130 so as to be movable between a closed position and an open position. As pressure within the cylinder 96 increases due to movement of the piston head 90 in the cylinder, the valve 98 opens, allowing fluid to flow through the bore 124. The fluid flows out of the bore 124 with increased pressure into the cap 100. Pressure is elevated because there is a relatively large volume of fluid within the chamber 96 which is being pressurized by the relatively large piston head 98 and is being forced through a relatively small bore 124 in the wall 126 of the barrel 96. As the fluid emerges from the bore 124 and into the cap 100, it is carried by a tube, channel or other means to an outlet orifice 132 (see FIGS. 1 and 2). The cap 100 may be of a number of configurations and as may be the outlet orifice 132. The structure of the stream emitted from the pump 10 is determined by the orifice 132 and other conventional structures within the cap 100 which determines if the liquid 12 emerges as a spray, a stream or perhaps a foam.

The cap 100 is snap-fitted onto the barrel by an annular rib-in-groove arrangement wherein a groove 140 in the barrel receives an annular rib 142 on the cap. In this way the cap 100 can rotate so as to align itself with a liquid expending structure (not shown) within the cap or to a position of non-alignment with such structure to provide an off-position.

After liquid has been ejected from the barrel through the bore 124 and the operator releases the trigger 70, spring 94 urges the piston head 90 back to the at rest position. This causes the valve 98 to close because of atmospheric air pressing against the outside surface 150 of the valve. Since the piston 90 is moving back to valve 92, the valve opens, allowing fluid in the piston tube 106 and suction tube 20 to flow through the bore 122 in the piston face 114 of the piston head 90 and accumulate in the chamber 96. When a state of equilibrium is reached, the suction valve 92 tends to stay closed as does the pressure valve 98. Since the chamber or barrel 96 is now at least partially filled with liquid, the chamber is charged for the next discharge or spray of liquid out through the orifice 132 of the pump 10. The next time the trigger 70 is squeezed, cams 74 and 76 advance the piston 90 against the bias of the spring 94 to discharge liquid within the chamber or barrel 96 through the bore 124. The cycle can repeat itself as long as there is liquid 12 in the container 14.

In order to allow the piston 90 to move, the suction tube 20 bends slightly so that the piston head 90 advances a sufficient distance in the cylinder or barrel 96 to eject the desired amount of liquid 12.

In order for the pump mechanism 22 to function effectively, it is necessary to vent the container 14. This may be accomplished in a conventional fashion by providing a vent between the cap 16 and the neck 18 or by including a stack extending up into the body portion 26. Such a stack is illustrated by the stack 160 has a normally closed valve 162 therein, the valve 162 opening when the container 14 drops below atmospheric pressure so that atmospheric air flows through the valve 162 down the stack 160 and into the space above the liquid 12 providing atmospheric air to force the liquid into the suction tube 20, through the piston tube 106 and into the chamber 96 as the piston 90 moves from its projected to its retracted position.

By the aforedescribed structures, pump 10 provides an inexpensive, easy to assemble, hand spray pump having a minimal number of parts which slide or snap together. Since the operation and structure of the pump is independent from the shape and structure of the housing, the pump mechanism 22 is separate from the housing 24 so that the housing 24 may have a number of different configurations. The pump mechanism 22 is assembled separately from the housing 24 from easily molded or extruded parts which are slid or snapped together. The trigger 70 is a separate component which is also relatively easily molded. The spray pump 10 is then assembled by first dropping the trigger 70 through the opening 86 in the body portion 26 of the housing 24. The pump mechanism 22 is then moved into engagement with the grooves and cut-outs in bulkheads 30 and 31 and in the end wall 60. Cover portion 28 is then snapped onto the body portion with detents 35, 36 and 38 engaging keepers 50, 52 and 54, to enclose the pump mechanism in the housing 24. Collar 16, which has been snapped onto the neck portion 17 of the body portion 26 of housing 24, is then threadably secured or otherwise mounted on the neck 18 of the container 14. The resulting spray pump 10 is of flexible design and configuration which is inexpensive and may be readily changed for any number of reasons.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A pump assembly for pumping liquid from a container, the pump assembly comprising:

a housing, the housing having a body portion and a separate cover portion, the portions including means for attaching the cover portion on the body portion;

a pump mechanism initially separate from and independent of the housing, the pump mechanism comprising a suction tube for extending from the pump assembly into the liquid within the container when the pump mechanism is mounted in the housing, a chamber for storing and discharging a charge of liquid, a piston reciprocal in the chamber for charging and discharging the chamber upon reciprocation therein, and a nozzle for dispensing liquid discharged from the chamber;

a separate trigger for operating the pump mechanism;

means for slidably mounting the trigger within the body portion of the housing;

support means within the body portion of the housing for slidably receiving the pump mechanism as a unit and aligning the pump mechanism with the trigger, whereby since the pump mechanism is an assembly initially independent of the housing prior to mounting the pump mechanism within the housing, the body portion and cover portion of the housing may be modified without modifying the pump mechanism.

2. The pump assembly of claim 1, wherein the support means comprises bulkheads within the housing extending thereacross, the bulkheads having notches therein for receiving components of the pump assembly and the cover portion having means thereon cooperating with the components for holding the components in the notches.

3. The pump assembly of claim 1, wherein the pump mechanism includes a cap mountable over the chamber and wherein the cap is disposed outside of the housing when the pump mechanism is mounted within the housing.

4. The pump assembly of claim 3 further including means for rotatably mounting the cap on the chamber.

5. The pump assembly of claim 1, wherein the chamber, piston and nozzle are disposed substantially perpendicular to the suction tube which extends from the pump assembly into the liquid within the container.

* * * * *